US010486020B2

(12) United States Patent
Sadikaj

(10) Patent No.: US 10,486,020 B2
(45) Date of Patent: Nov. 26, 2019

(54) EXERCISE APPARATUS

(71) Applicant: Albi Sadikaj, Fort Washington, MD (US)

(72) Inventor: Albi Sadikaj, Fort Washington, MD (US)

( * ) Notice: Subject to any disclaimer, the term of this patent is extended or adjusted under 35 U.S.C. 154(b) by 172 days.

(21) Appl. No.: 15/583,472

(22) Filed: May 1, 2017

(65) Prior Publication Data

US 2018/0311529 A1 Nov. 1, 2018

(51) Int. Cl.

| | |
|---|---|
| ***A63B 23/02*** | (2006.01) |
| ***A63B 23/04*** | (2006.01) |
| ***A63B 21/00*** | (2006.01) |
| ***A63B 21/072*** | (2006.01) |
| ***A63B 21/055*** | (2006.01) |

(52) U.S. Cl.

CPC ..... *A63B 23/0211* (2013.01); *A63B 21/0552* (2013.01); *A63B 21/0724* (2013.01); *A63B 21/4039* (2015.10); *A63B 23/0405* (2013.01); *A63B 2023/0411* (2013.01); *A63B 2225/093* (2013.01)

(58) Field of Classification Search

CPC .... A63B 1/00; A63B 3/00; A63B 4/00; A63B 21/068; A63B 21/08; A63B 21/15; A63B 21/159; A63B 21/16; A63B 21/4027; A63B 21/4029; A63B 21/4031; A63B 21/4033; A63B 21/4039; A63B 21/4045; A63B 22/0046; A63B 22/0087; A63B 22/20; A63B 22/201; A63B 22/203; A63B 23/02; A63B 23/0205; A63B 23/0211; A63B 23/0222; A63B 23/04; A63B 23/0405; A63B 23/047; A63B 23/0482; A63B 23/0494; A63B 2023/006; A63B 2023/0411; A63B 69/0057; A63B 69/0059; A63B 69/0064; A63B 2069/0062; A63B 71/0036; A63B 71/02; A63B 71/023; A63B 2071/025; A63B 2071/026; A63B 2071/027; A63B 2208/02; A63B 2208/0204; A63B 2208/0223; A63B 2208/0285; A63B 2208/029; A63B 2210/00; A63B 2210/50; A63B 2225/09; A63B 2225/093; A63B 2225/10; A63B 2225/105

See application file for complete search history.

(56) References Cited

U.S. PATENT DOCUMENTS

| | | | |
|---|---|---|---|
| 2,759,730 | A | 8/1956 | Berry |
| 3,682,475 | A | 8/1972 | Walker |

(Continued)

*Primary Examiner* — Gary D Urbiel Goldner

(74) *Attorney, Agent, or Firm* — Nath, Goldberg & Meyer; Joshua B. Goldberg; Daniel Bissing

(57) ABSTRACT

An exercise apparatus including a base frame, a vertical support assembly, and a receiving mechanism. The vertical support assembly is attached to the base frame and is height adjustable in order to accommodate users of various heights. The receiving mechanism is located adjacent and proximal to the vertical support assembly. The receiving mechanism is configured to move in a direction perpendicular to the vertical support assembly to adjust the angle between the vertical support assembly and the receiving mechanism. The exercise apparatus substantially stabilizes a user's lower legs and feet in order to allow a user to perform a combination squat and crunch exercise without assistance.

10 Claims, 7 Drawing Sheets

(56) References Cited

U.S. PATENT DOCUMENTS 4,046,373 A * 9/1977 Kim ..... A63B 21/00047 482/145
4,508,335 A 4/1985 Kelley
4,509,748 A 4/1985 Bezak
5,066,005 A * 11/1991 Luecke ..... A63B 21/0552 482/130
5,120,052 A 6/1992 Evans
5,263,919 A * 11/1993 Hollenback ..... A63B 21/00047 482/142
5,674,168 A * 10/1997 Wilkinson ..... A63B 22/0023 482/115
5,941,806 A 8/1999 Olschansky
6,048,293 A 4/2000 Lee
6,589,142 B2 * 7/2003 McAfee, Jr. ..... A63B 21/023 482/133
7,125,369 B2 * 10/2006 Endelman ..... A63B 21/023 482/142
7,128,701 B1 * 10/2006 Ketcham ..... A63B 21/00047 482/142
7,857,736 B2 * 12/2010 Merrithew ..... A63B 21/00 482/121
8,105,206 B2 * 1/2012 Rindfleisch ..... A63B 21/00178 482/1
8,172,736 B2 * 5/2012 Contreras ..... A63B 21/00047 482/140
8,602,953 B2 * 12/2013 Jordan ..... A63B 21/055 482/121
9,302,149 B1 * 4/2016 Parker ..... A63B 17/04
9,687,693 B2 * 6/2017 Archer ..... A63B 69/0057
2003/0119635 A1 * 6/2003 Arbuckle ..... A63B 22/0087 482/142
2005/0143233 A1 6/2005 Shifferaw
2006/0183606 A1 * 8/2006 Parmater ..... A63B 22/0076 482/72
2010/0179038 A1 * 7/2010 Hahn ..... A63B 17/00 482/142
2014/0141948 A1 * 5/2014 Aronson ..... A63B 21/023 482/128
2015/0065320 A1 * 3/2015 Anderson ..... A63B 21/0428 482/142

* cited by examiner

EXERCISE APPARATUS

FIELD

The present subject matter generally relates to an exercise apparatus and related method of use for physical fitness and physical therapy, such as, e.g., abdominal strengthening exercises. More particularly, the present subject matter relates to a dynamic, compact exercise apparatus that can be used to provide a combination exercise for a total body workout.

BACKGROUND INFORMATION

Exercise machines that provide resistance to the movement of various muscular groups are commonly known. These exercise machines are available in various configurations and for various purposes, and are provided to target different major muscle groups. The majority of such equipment and machines, especially in the exercise field, concentrate either on an aerobic or anaerobic workout or on specific areas or muscle groups of the body such as the legs, the hips and lower torso, the chest and upper torso, the back, the shoulders and the arms. The individual operations of these machines generally concentrate on a single muscle group such as biceps, pectorals, quadriceps and so forth.

Generally, such equipment and machines can be categorized into three broad categories: free weights, mechanically operated single action resistance machines, and electrically operated resistance machines. Mechanically operated single action resistance machines can be subcategorized into three broad categories: stack weight resistance operated, free weight resistance operated, and alternative resistance operated. Mechanically operated single action resistance machines are available for exercising, strengthening and rehabilitating various individual muscles, muscle groups, combinations of muscle groups, joints, and other parts of the body.

Current abdominal muscle exercise machines generally target only the abdominal muscles and no other muscles. However, many people would prefer to have one machine that is capable of targeting additional muscles or muscle groups concurrently with the abdominal muscles to provide a total body workout. Use of such a machine would provide a more complete workout in the same amount of time, since at least two muscles or muscle groups could be exercised concurrently. It would be beneficial if the apparatus could enable a user to execute the abdominal exercise in a neutral position, minimizing or eliminating back and neck strain. It would also be beneficial if the user could perform an abdominal crunch simultaneously with a controlled squat. It would further be beneficial if the apparatus could allow the user to hold either the crunching or squatting position in a fully contracted isometric position while continuing with the opposite crunch rendering a dynamically concentrated isolation of the abdominal muscles.

The present subject matter satisfies a need which, notwithstanding the prolific development in the art, still exists in the field of exercise machines. As discussed above, the prior art does not teach a single exercise machine which combines features for abdominal exercises and squatting to provide a total body workout. Further, the exercise machines which might possibly be adapted for such a combination of exercises are of considerable size and weight, or require a plurality of moving parts. Finally, exercise machines which have features for more than a single type of exercise, usually involve completely independent mechanisms which simply share a common frame.

BRIEF SUMMARY

In view of the foregoing disadvantages inherent in the known types of exercise equipment now present, the present subject matter provides a dynamic exercise apparatus which can be used for a total body workout and particularly targets the abdominal core muscles. Embodiments of the present disclosure are directed to an exercise apparatus and related method of exercising that provides a total body workout using a complex exercise, such as, e.g., a combination squatting/crunching and/or reverse crunch exercise. For example, the exercise apparatus can allow a user to perform plyometric or weight assisted exercise that simultaneously provides a combination squat and reverse crunch exercise followed by a crunch and reverse squat.

In one embodiment, the exercise apparatus may include a base frame, a vertical support assembly, and a receiving mechanism. The vertical support assembly is attached to the base and is height adjustable in order to accommodate users of various heights. The receiving mechanism is located adjacent and proximal to the vertical support assembly. The receiving mechanism is configured to move in a direction perpendicular to the vertical support assembly to adjust the angle between the vertical support assembly and the receiving mechanism.

According to another embodiment, the exercise apparatus may include a base frame, a vertical support assembly, and a receiving mechanism. The base frame includes a first sidewall, a second sidewall, and an end wall. The base frame further includes at least two guide rails parallel to and between the first sidewall and the second sidewall. The guide rails are perpendicular and adjacent to the end wall. The vertical support assembly is removably attached to the base frame. The vertical support assembly includes a first upright support bar and a second upright support bar extending perpendicular to the base frame on the first sidewall and second sidewall, respectively. A connecting bar is removably attached to the first upright support bar and the second upright support bar. The connecting bar includes two leg supports that telescope within the first upright support bar and the second upright support bar, respectively, in order to adjust the height of the vertical support assembly.

In some embodiments, the receiving mechanism is mounted on the guide rails. The receiving mechanism is proximal and aligned with the vertical support assembly. The receiving mechanism is configured to slide on the guide rails parallel to the first sidewall and the second sidewall in order to provide a desired angle between the vertical support assembly and the receiving mechanism.

In yet another embodiment, a method for exercising is provided. First, an exercise apparatus having a receiving mechanism and a vertical support assembly is provided. The receiving mechanism is adjacent to the vertical support assembly and is configured to move in a direction perpendicular to the vertical support assembly. After the exercise apparatus is provided, a height of the vertical support assembly is adjusted such that the vertical support assembly is located below the popliteal area, i.e, behind a user's knees. After the height of the vertical support assembly is adjusted, the receiving mechanism is adjusted in a direction perpendicular to the vertical support assembly such that an angle between the receiving mechanism and the vertical support assembly is in a range of 0 to 60 degrees. After the receiving mechanism is adjusted, a user places their feet underneath one or more supports of the receiving mechanism and adjusts the one or more supports of the receiving mechanism in a vertical direction to substantially immobilize a user's tibia and feet. After the receiving mechanism is adjusted, a user performs a squatting exercise until the user is in a substantially seated position. Then, the user continues downward until the user's back is substantially horizontal with a floor. Finally, the user performs a sit-up and squats back up to an upright position to complete the exercise.

Other objects, features and advantages of the present subject matter will become apparent from the following detailed description taken in conjunction with the accompanying drawings.

BRIEF DESCRIPTION OF THE DRAWINGS

The accompanying drawings, which incorporated in and constitute a part of this specification, illustrate exemplary embodiments of the present disclosure and together with the description, serve to explain the principles of the disclosure.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts. For purposes of this disclosure, "crunch" and "sit-up" refer to exercises targeting the abdominal area and "reverse crunch" or "reverse sit-up" refers to an movement opposite to the crunch or sit-up.

Overview

The exercise apparatus of the present subject matter provides a single apparatus that can be used to perform a plurality of different exercises targeting multiple muscle groups of a user. First, the exercise apparatus reduces the stress placed on a user's lower back region during the performance of sit-up type exercises by immobilizing a region of the lower legs. Secondly, the exercise apparatus substantially stabilizes a user's legs and feet in an upright position, thereby removing the need for additional support from others, such as spotters. In this way, the present exercise machine allows a user to only bend their knees in order to perform a squat/abdominal exercise without assistance or excess strain. Third, the present exercise apparatus provides a compact and portable apparatus that can be used for a dynamic total body workout.

Embodiments of the disclosure are directed to an exercise apparatus and related method of exercising that provides a total body workout using a complex exercise, such as, e.g., a combination squatting/crunching and/or reverse crunch exercise, among others. More particularly, the disclosure relates to an exercise apparatus and related method that substantially stabilizes a user's lower legs and feet in order to perform squat and crunch exercises without assistance.

Exemplary Embodiments

Figure 1:
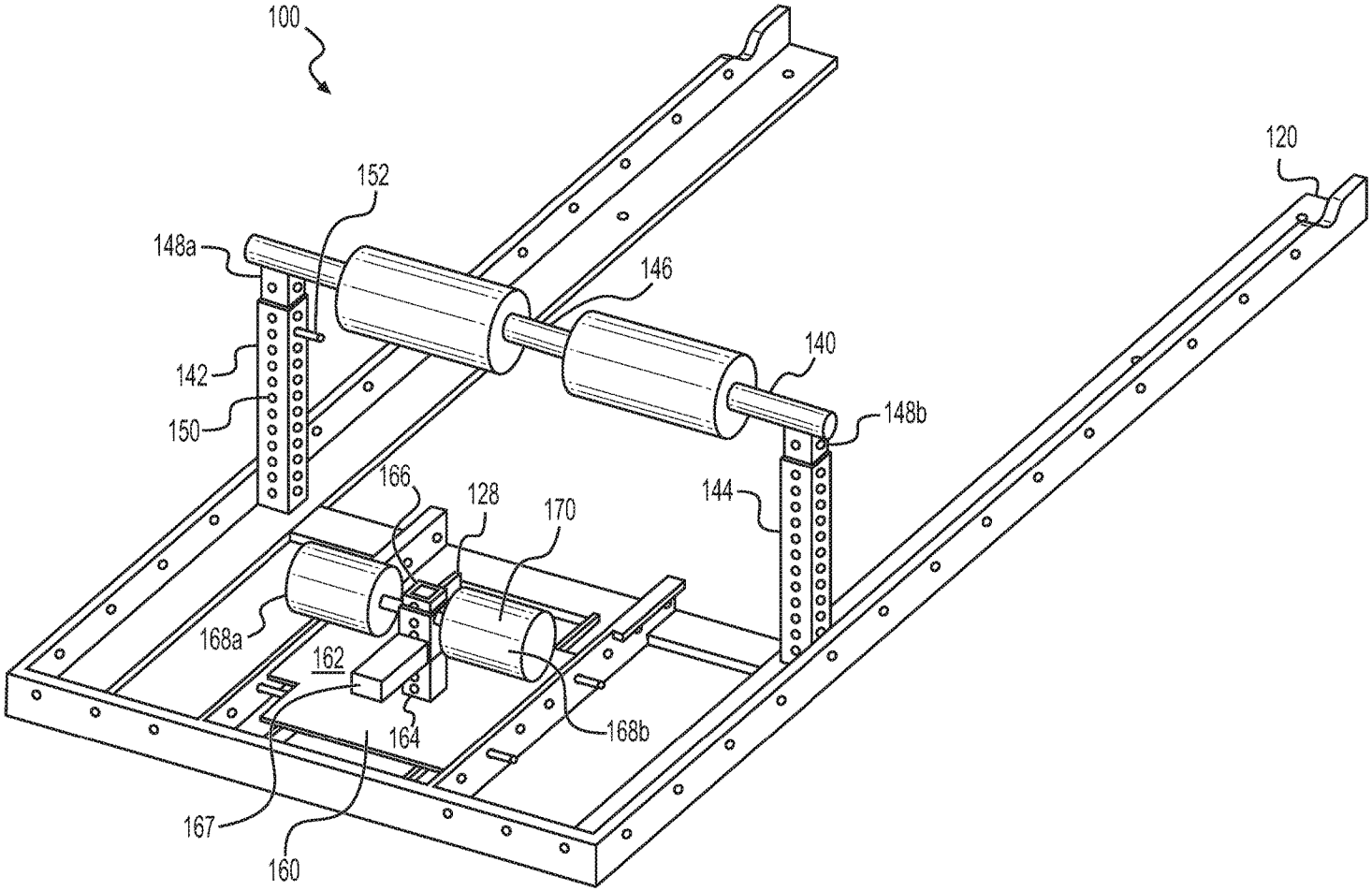
FIG. 1 is a top perspective view of an exercise apparatus according to one embodiment.

Referring to the drawings in detail, wherein like numerals indicate like elements throughout several views, FIG. 1 shows a top perspective view of an exercise apparatus 100 according to one embodiment. The exercise apparatus includes three primary components: a base frame 120; a vertical support assembly 140; and a receiving mechanism 160. In some embodiments, the vertical support assembly 140 and the receiving mechanism 160 can be removably attached to the base frame 120. In the alternative, the exercise apparatus 100 may comprise a unitary structure having the vertical support assembly 140 and the receiving mechanism 160 permanently attached, or welded, to the base frame 120.

According to this embodiment, the main body of the exercise apparatus 100 is the base frame 120. The vertical support assembly 140 is attached to the base frame 120. The vertical support assembly 140 is height adjustable. The receiving mechanism 160 is adjacent to the vertical support assembly and is configured to move in a direction perpendicular to the vertical support assembly 140 in order to provide a range of angles between the vertical support assembly 140 and the receiving mechanism 160. Depending on the height and weight of a user, the height of the vertical support assembly 140 can be adjusted such that it is below a user's knees. Correspondingly, the receiving mechanism 160 can be adjusted such that a user's legs are substantially upright and abutting the vertical support assembly 140 when a user's feet are secured on the receiving mechanism 160.

According to further embodiments, the base frame 120 is configured to rest flat against a floor surface. In some embodiments, the base frame 120 includes a plurality of holes such that the base frame 120 can be permanently secured to a flooring surface. When the base frame 120 is secured to the floor, the exercise apparatus 100 has increased stability and is not subject to undue movement from vigorous exercise.

The vertical support assembly 140 includes a first upright support bar 142 and second upright support bar 144 extending perpendicular to the base frame 120. In some embodiments, first upright support bar 142 and second upright support bar 144 are removably attached to the base frame 120. The vertical support assembly 140 further includes a connecting bar 146 comprising two leg supports 148*a*, 148*b* that are removably attached to the first upright support bar 142 and second upright support bar 144, respectively. The two leg supports 148*a*, 148*b* telescope within the first upright support bar 142 and the second upright support bar 144, respectively. The connecting bar 146, the first upright support bar 142 and the second upright support bar 144, each include a plurality of holes 150 along the length of each component. In this way, the two leg supports 148*a*, 148*b* of the connecting bar 146 are removably attached to the first upright support bar 142 and the second upright support bar 144 by a pin 152 when the holes of each component are aligned.

According to another embodiment the base frame 120 further includes one or more guide rails 128. The receiving mechanism 160 is mounted on the one or more guide rails 128 to slidably attach the receiving mechanism 160 to the base frame 120. That is, the guide rails allow the receiving mechanism 160 to move in a direction perpendicular to the vertical support assembly 140 in order to provide a range of angles between the vertical support assembly 140 and the receiving mechanism 160. The receiving mechanism 160 includes a base plate 162 having a support surface 164 that is perpendicular to the base plate 162. The support surface 164 includes a mating channel 166 that telescopes on a periphery of the support surface 164. The mating channel 166 and the support surface 164 each comprise a plurality of holes. When the holes on the mating channel 166 and the support surface 164 are aligned, a fastener, such as a pin, releasably couples the mating channel to the support surface 164 at a desired height on the support surface 164. The mating channel 166 includes two perpendicular supports 168*a*, 168*b* having one or more pads 170 thereon.

Figure 2A:
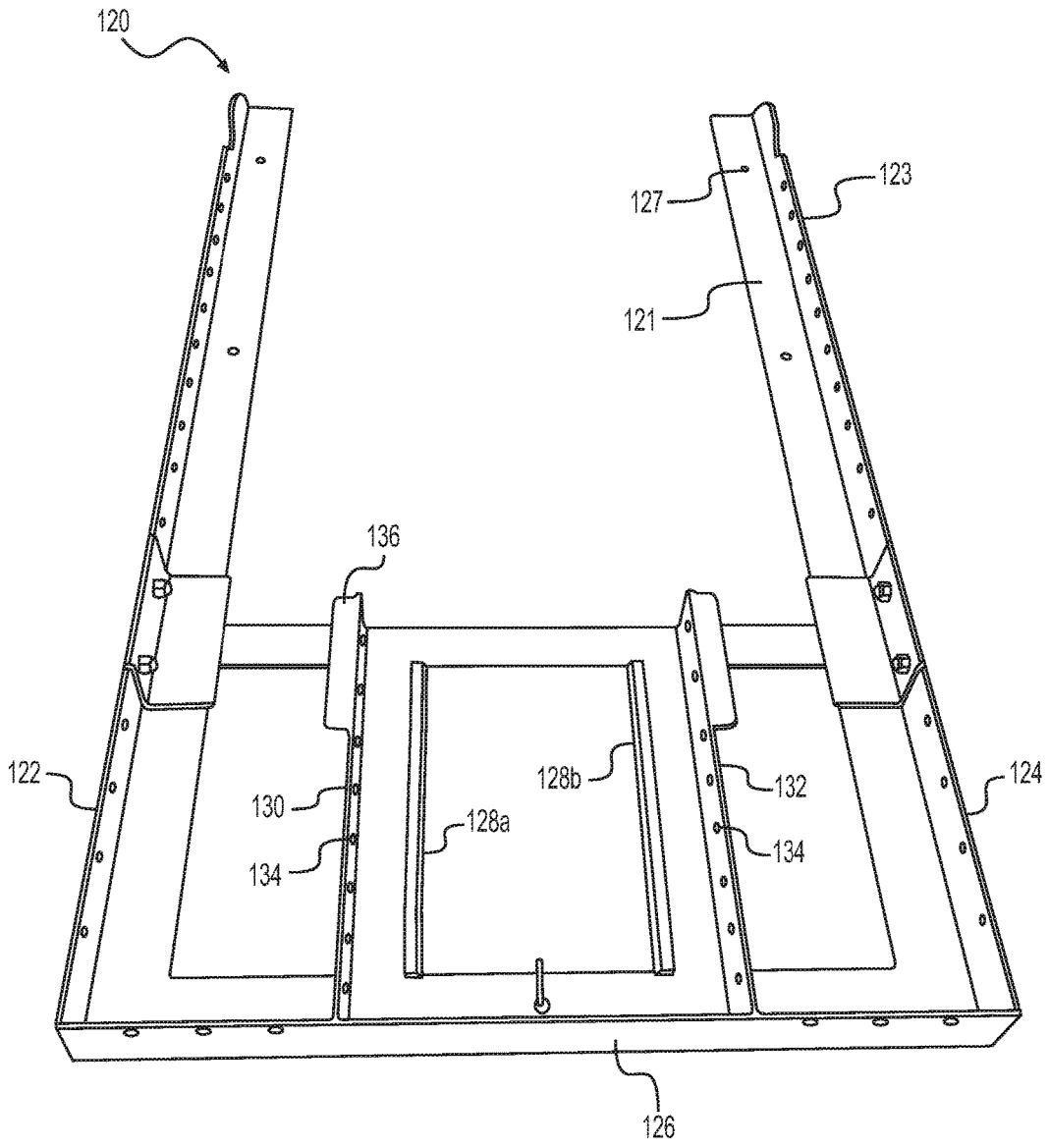
FIG. 2*a* is a front perspective view of a base frame of the exercise apparatus according to another embodiment.
Figure 2B:
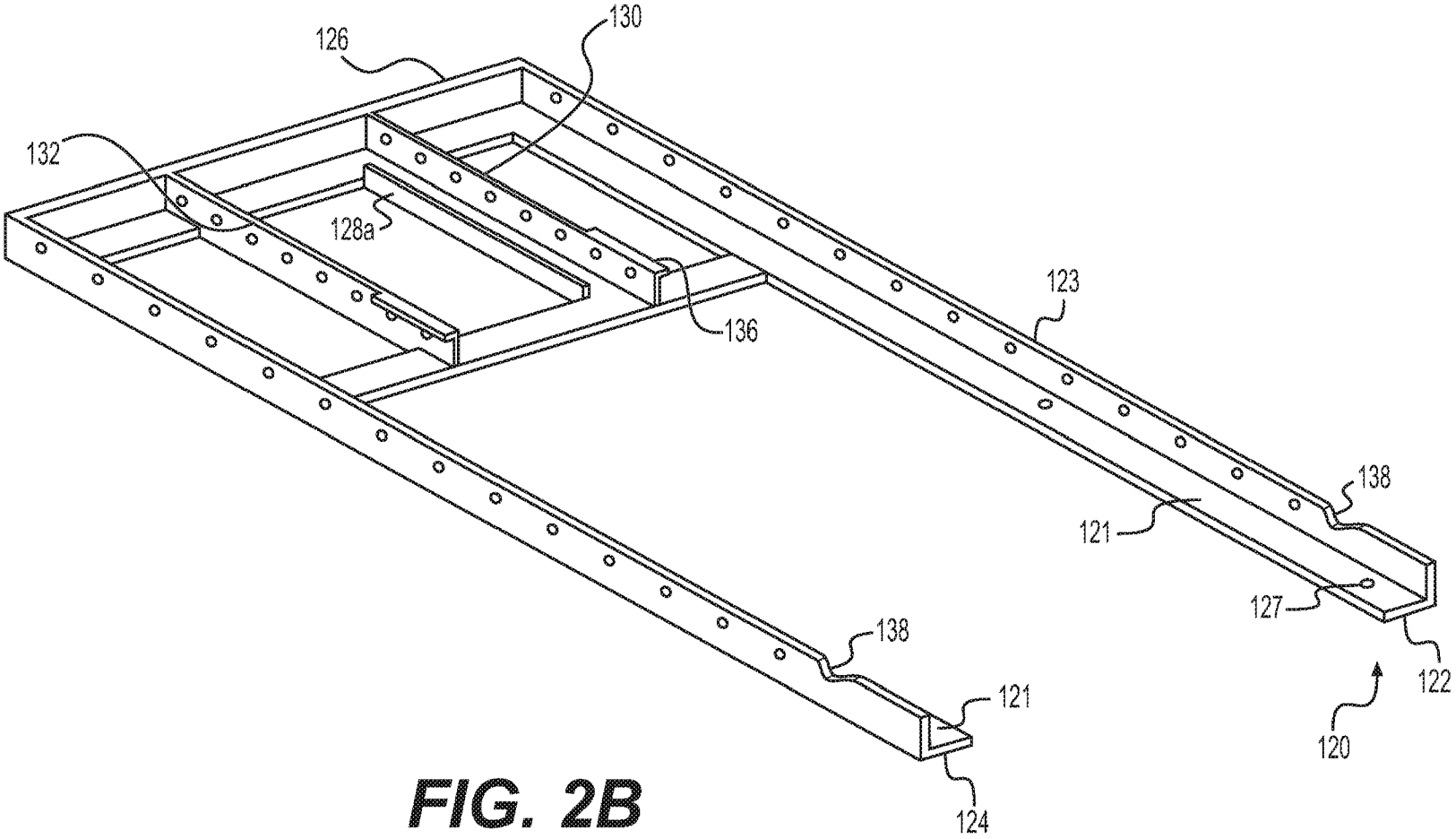
FIG. 2*b* is a rear perspective view of a base frame of the exercise apparatus according to another embodiment.

According to another embodiment of the exercise apparatus, as shown in FIGS. 2*a* and 2*b*, the base frame 120 includes a first sidewall 122, a second sidewall 124, and an end wall 126. In some embodiments, base frame 120 is substantially U-shaped with the end wall 126 connecting the first sidewall 122 and the second sidewall 124. The first sidewall 122, second sidewall 124, and end wall 126 are integrally attached to form the body of the base frame 120.

In some embodiments, the base frame 120 includes two adjacent guide rails 128*a*, 128*b* that are parallel to and between the first sidewall 122 and the second sidewall 124. The two guide rails 128*a*, 128*b* are perpendicular and adjacent to the end wall 126. The guide rails 128*a*, 128*b* are spaced apart relative to each other to provide a space therebetween and each of the guide rails 128*a*, 128*b* are of equal length. A first support wall 130 and a second support wall 132 are adjacent to each of the guide rails 128*a*, 128*b*, respectively. The first support wall 130 and the second support wall 132 each include one or more holes 134 that are aligned with each other. The first support wall 130 is parallel to and between the first sidewall 122 and guide rail 128*a* and the second support wall 132 is parallel to and between the second sidewall 124 and the other guide rail 128*b*. Therefore, the support walls 130, 132 are not in the space between the guide rails 128*a*, 128*b*.

The first support wall 130 and the second support wall 132 may further include a flange 136 at a terminal end thereof. The flange 136 protrudes in a direction away from the guide rails 128*a*, 128*b* and towards the first sidewall 122 and/or the second sidewall 124, respectively. The first support wall 130 and the second support wall 132 delineate sections adjacent to the guide rails 128*a*, 128*b* that do not hold the receiving mechanism 160. These sections may include one or more pads therein which are secured underneath the flanges 136 of the support walls 130, 132.

According to other embodiments of the base frame 120, each sidewall 122, 124 may include one or more concave cutout portions 138. The cutout portions 138 are located near the distal end of each sidewall 122, 124 and are provided to receive one or more weight training bars, i.e., barbells.

As shown in FIG. 2*b*, the first sidewall 122, the second sidewall 124, and the end wall 126 of the base frame 120 are L-shaped walls according to one embodiment. The first sidewall 122, the second sidewall 124, and the end wall 126 are integrally attached to form the unitary structure of the base frame 120. The base portion 121 of each of the walls includes one or more securing holes 127 that are adapted to receive fasteners. The fasteners may be optionally provided in the securing holes 127 to secure the base frame 120 to a flooring surface. In some embodiments, the perpendicular upright portion 123 also includes one or more holes. These holes on the perpendicular upright portion 123 are configured to receive the vertical support assembly. Alternatively, they can receive other exercise equipment such as, e.g., resistance bands.

Figure 3:
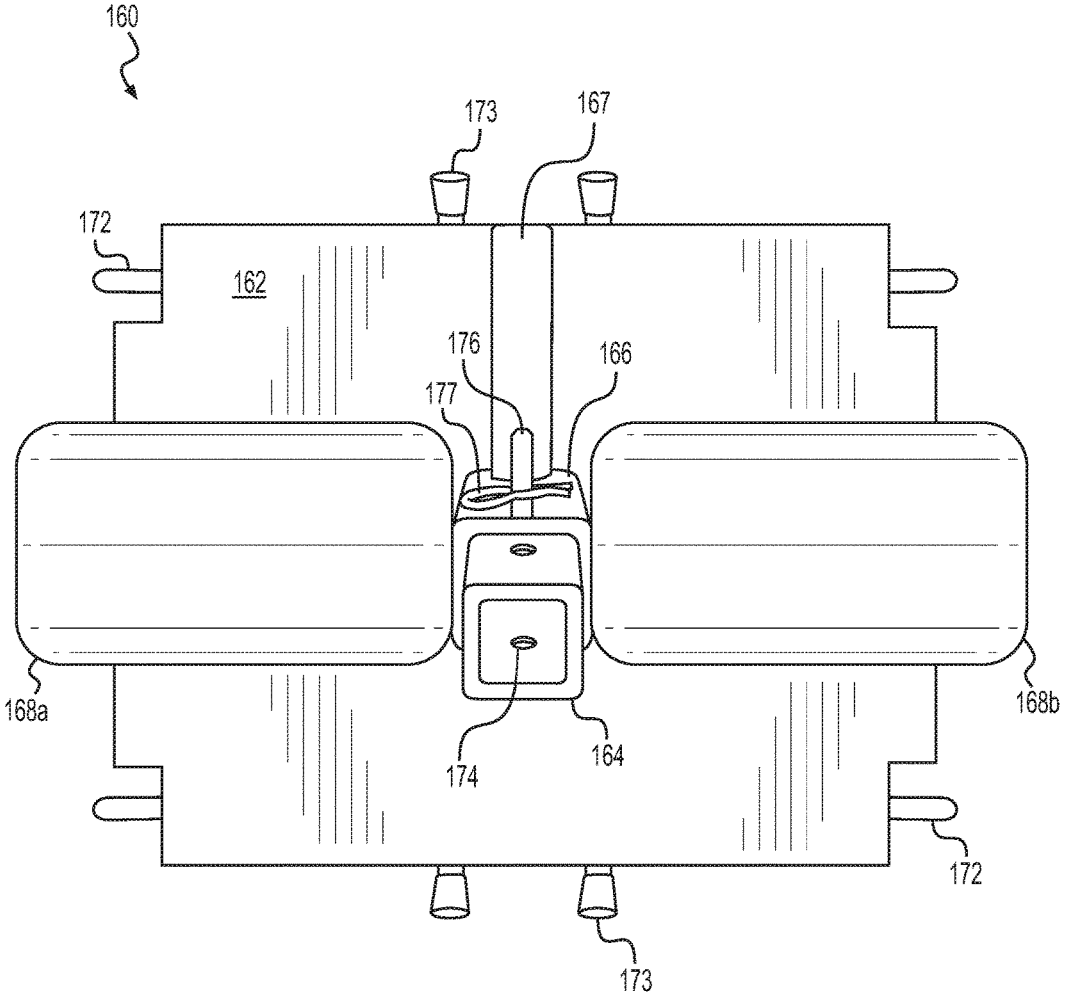
FIG. 3 is an overhead view of the receiving mechanism according to one embodiment.

FIG. 3 depicts an overhead view of the receiving mechanism 160 of the exercise apparatus 100 according to one embodiment. The receiving mechanism 160 includes two main assemblies that allow the receiving mechanism 160 to slide along the guide rails 128*a*, 128*b* and, secondly, adjust one or more supports 168*a*, 168*b* of the receiving mechanism 160 to secure a user's feet on the receiving mechanism 160. The receiving mechanism 160 includes a base plate 162 and a support surface 164 perpendicular to the base plate 162. The base plate 162 is a flat surface that is substantially rectangular. The flat surface of the base plate 162 is configured to receive a user's feet thereon.

In one embodiment, the support surface 164 is a tubular shaft extending perpendicular to the base plate 162 in an upright position. The support surface 164 is located at a center portion of the base plate 162. The support surface 164 includes a mating channel 166 that telescopes on a periphery of the support surface 166. In other words, the mating channel 166 can slide along the length of the support surface 164 to increase or decrease the height of the receiving mechanism 160. The support surface 164 and mating channel 166 include a plurality of holes 174 along the length thereof. The mating channel 166 is releasably coupled to the support surface 164 via a removable pin 176 that is inserted into the corresponding holes of the support surface 164 and the mating channel 166 when the holes of the support surface 164 and the mating channel 166 are aligned. In some embodiments, the removable pin 176 may further include a hitch pin clip 177 to prevent the removable pin 176 from sliding out of the holes. The mating channel 166 may further comprise a handle 167 for easily sliding the mating channel 166 on the support surface 164.

In some embodiments, the receiving mechanism 160 is configured to be removably attached to the base frame 120. In particular, the receiving mechanism 160 can be attached to the first support wall 130 and the second support wall 132 of the base frame 120. For example, the receiving mechanism 160 may include one or more locking pins 172 that are actuated via a locking pin handle 173. The locking pins 172 are retained in the one or more holes 134 of the first support wall 130 and the second support wall 132 to fasten the receiving mechanism 160 to the base frame 120. Preferably, the locking pins 172 are spring loaded. This enables the receiving mechanism 160 to be attached at various locations on the base frame 120, relative to the vertical support assembly 140, to provide various angles for performing an exercise.

Figure 4:
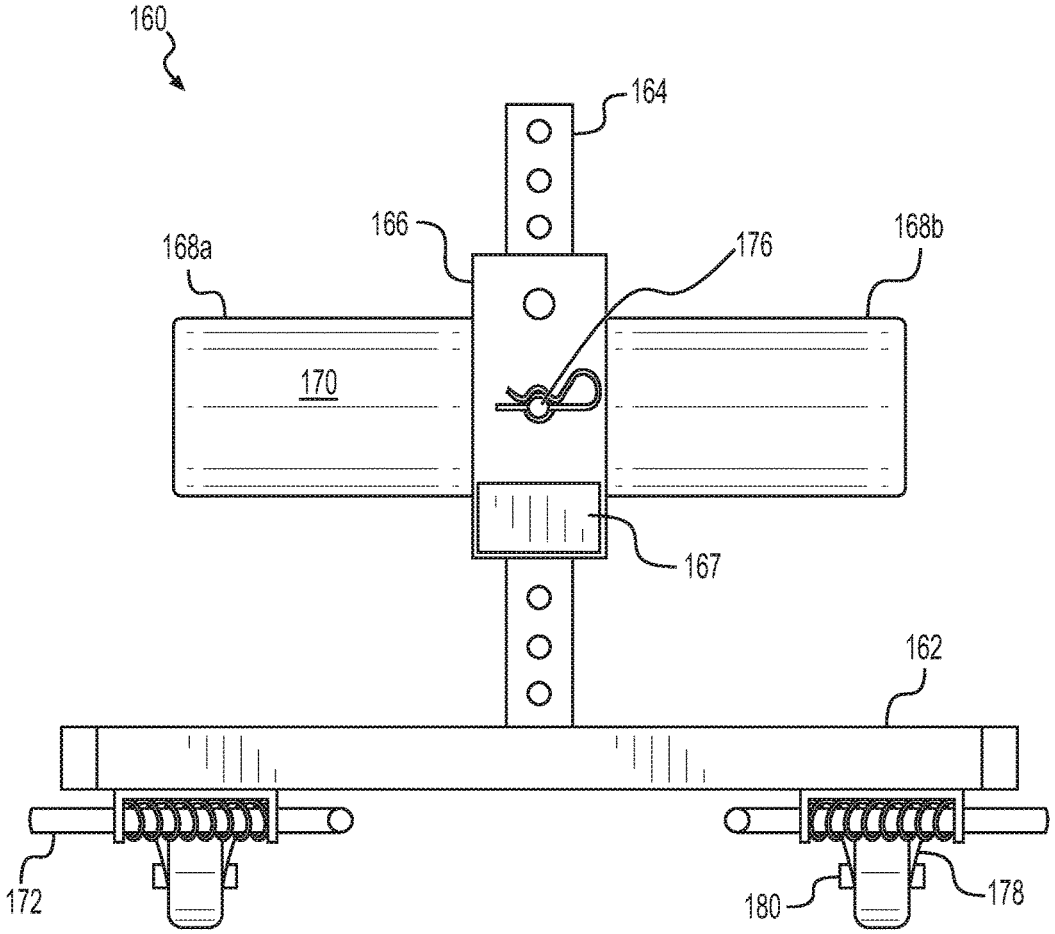
FIG. 4 is a side view of the receiving mechanism according to another embodiment.

FIG. 4 illustrates a side view of the receiving mechanism 160 according to one embodiment. The mating channel 166 of the receiving mechanism 160 includes at least two perpendicular supports 168*a*, 168*b* on opposing ends of the mating channel 166. The perpendicular supports 168*a*, 168*b* may include one or more pads 170 thereon. The perpendicular supports 168*a*, 168*b* are provided at various heights along the support surface 164 by adjusting the location of the mating channel 166 on the support surface 164. In use, a user can adjust the height of the receiving mechanism 160 to securely fasten a user's feet between the base plate 142 and the perpendicular supports 168*a*, 168*b* of the mating channel 166. In particular, a user can remove the pin 176 and move the mating channel 166 via the handle 167 until the pads on the perpendicular supports 168*a*, 168*b* rest against the user's feet. Thereafter, the pin 176 is placed in the corresponding holes of the support surface 164 and the mating channel 166 to lock the mating channel 166 in place on the support surface 164. This ensures that the perpendicular supports 168*a*, 168*b* are substantially contacting a user's feet in order to keep them substantially immobilized during exercise.

In some embodiments, the base plate 162 of the receiving mechanism 160 includes at least four roller assemblies 178 on a bottom portion thereof. The roller assemblies 178 are in a spaced apart orientation relative to each other and adjacent to the corners of the receiving mechanism 160. In use, the roller assemblies 178 are adapted to slide on the guide rails 128*a*, 128*b* of the base frame 120.

Figure 5:
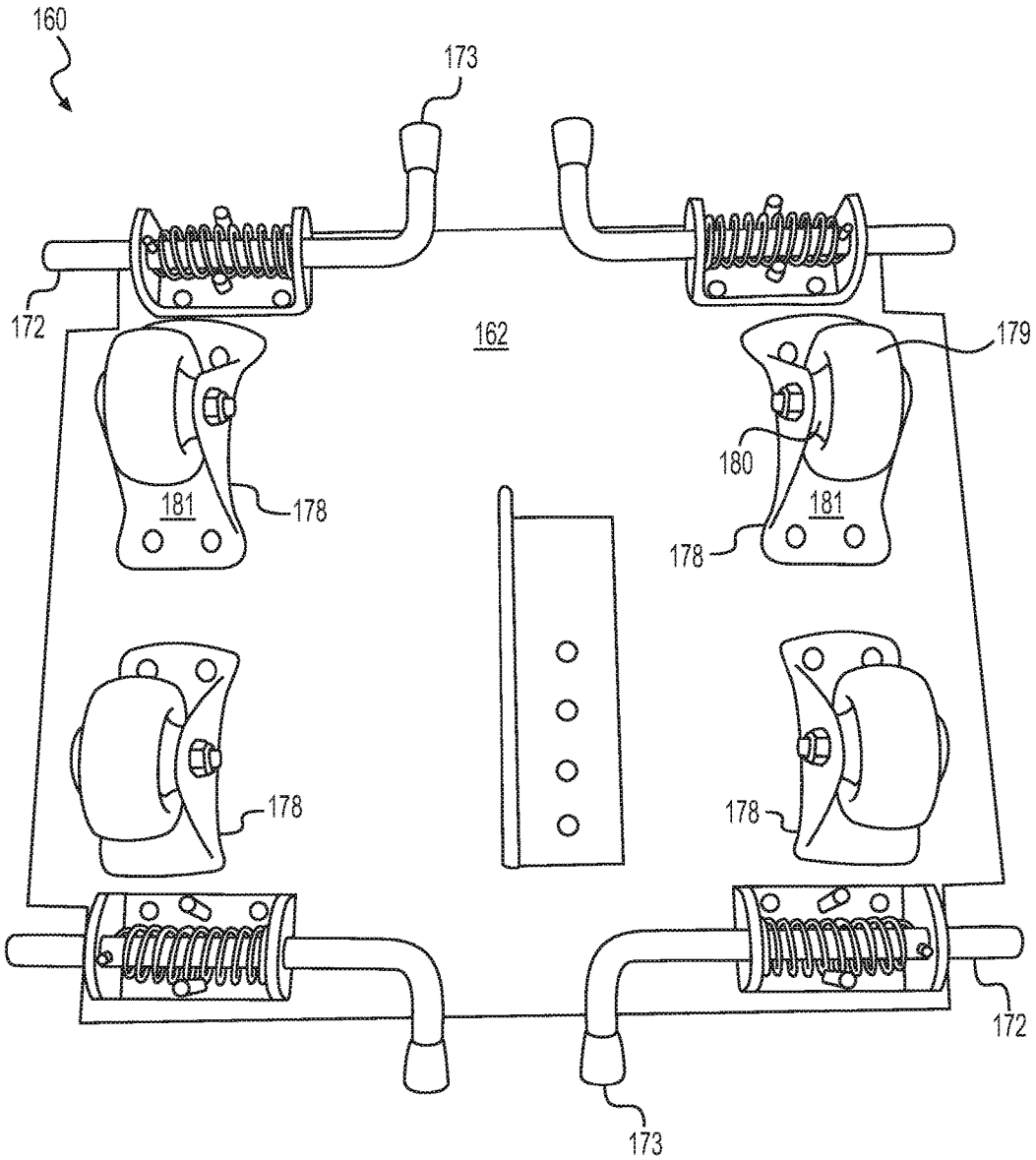
FIG. 5 is a bottom view of the receiving mechanism according to yet another embodiment.

FIG. 5 illustrates a bottom view of the receiving mechanism 160 according to one embodiment. The receiving mechanism 160 may include an assembly that enables the receiving mechanism 160 to move parallel to the sidewalls of the base frame 120. For example, beneath the base plate 162 of the receiving mechanism 160, one or more roller assemblies 178 are provided. The roller assemblies 178 are mounted on the bottom portion of the base plate 162 and each roller assembly 178 includes a wheel 179, a roller axle 180, and a roller plate 181. This allows a user to adjust the orientation of the receiving mechanism 160 relative to the vertical support assembly 140 to provide various angles for performing an exercise.

According to the embodiment illustrated in FIG. 5, the one or more roller assemblies 178 are configured to slide on the guide rails of the base frame via the wheels 179. In particular, the bottom side of the base plate 162 includes at least four roller assemblies 178 in a spaced apart orientation relative to each other and adjacent to the corners of the receiving mechanism 160. In this way, four roller assemblies 178 at each corner of the base plate 162 are adjacent to the guide rails. The four roller assemblies each have a roller plate 181 which is provide to affix the roller assembly to the base plate 162.

As explained above, the receiving mechanism 160 is configured to removably attach to the base frame 120, particularly to the first support wall 130 and second support wall 132 of the base frame 120. For example, the receiving mechanism 160 may include one or more spring loaded locking pins 172 that are actuated via a locking pin handle 173. This enables the receiving mechanism 160 to be attached at various portions of the first support wall 130 and second support wall 132 along the guide rails.

Figure 6:
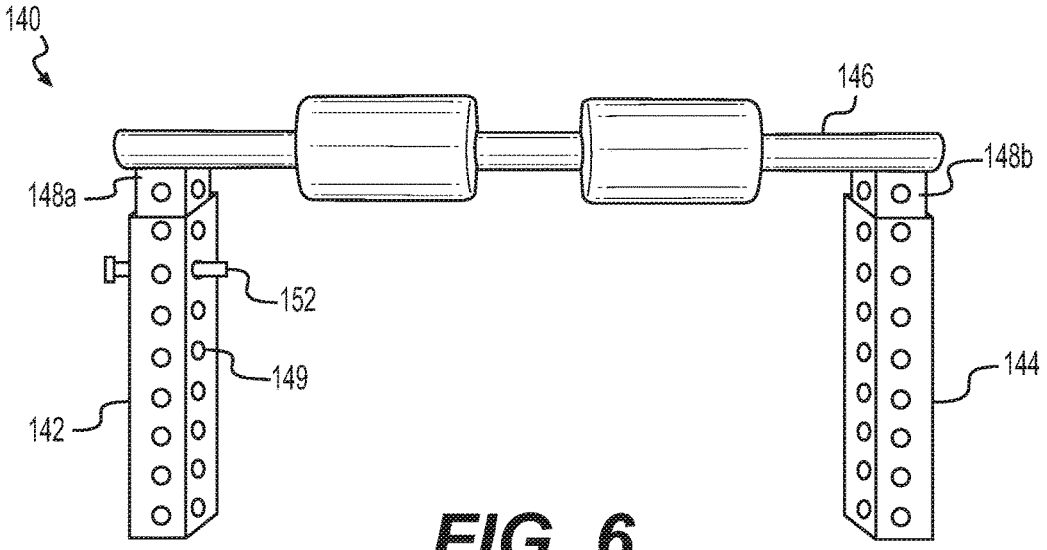
FIG. 6 is a front perspective view of the vertical support assembly according to one embodiment.

Referring now to FIG. 6, there is shown a front perspective view of the vertical support assembly 140 according to one embodiment. The primary purpose of the vertical support assembly 140 is to support the legs of a user from behind when a user's feet are secured on the receiving mechanism 160. More specifically, when a user's feet are secured in the receiving mechanism 160, the vertical support assembly 140 is correspondingly adjusted relative to the receiving mechanism 160 to provide an ideal angle for exercising.

The vertical support assembly 140 includes a first upright support bar 142 and a second upright support bar 144. The first upright support bar 142 and a second upright support bar 144 are removably attached to the base frame. For example, the first upright support bar 142 may extend perpendicular to the base frame 120 on the first sidewall 122 and the second upright support bar 144 may extend perpendicular to the base frame 120 on the second sidewall 124. A connecting bar 146 is removably attached to the first upright support bar 142 and the second upright support bar 144.

The connecting bar 146 includes two support legs 148*a*, 148*b* at opposing ends thereof. The two support legs 148*a*, 148*b* telescope within the first upright support bar 142 and the second upright support bar 144, respectively. The first upright support bar 142, the second upright support bar 144, and the two support legs 148*a*, 148*b* each comprise a plurality of holes 149. A removable pin 152 locks the two support legs 148*a*, 148*b* in the first upright support bar 142 and the second upright support bar 144, respectively, when the holes are aligned at a desired height.

In use, a user can adjust the height of the vertical support assembly 140 by fastening the connecting bar 146 at a desired height along the first upright support bar 142 and the second upright support bar 144. Initially, the first upright support bar 142 and the second upright support bar 144 must be secured on the sidewalls of the base frame 120 before the height of the connecting bar 146 is adjusted. For example, the telescoping support legs 148*a*, 148*b* of the connecting bar 146 are inserted into each respective first upright support bar 142 and second upright support bar 144. At the desired height, a user can align the holes of the support legs 148*a*, 148*b* and the support bars 142, 144 and insert a fastener, such as, e.g, a removable pin, to fasten the vertical support assembly 140. Preferably, the connecting bar 146 is slightly below the popliteal area of the user to enable a user to bend backwards over the connecting bar 146. In some embodiments, each upright support bar 142, 144 can include height markings.

Figure 7:
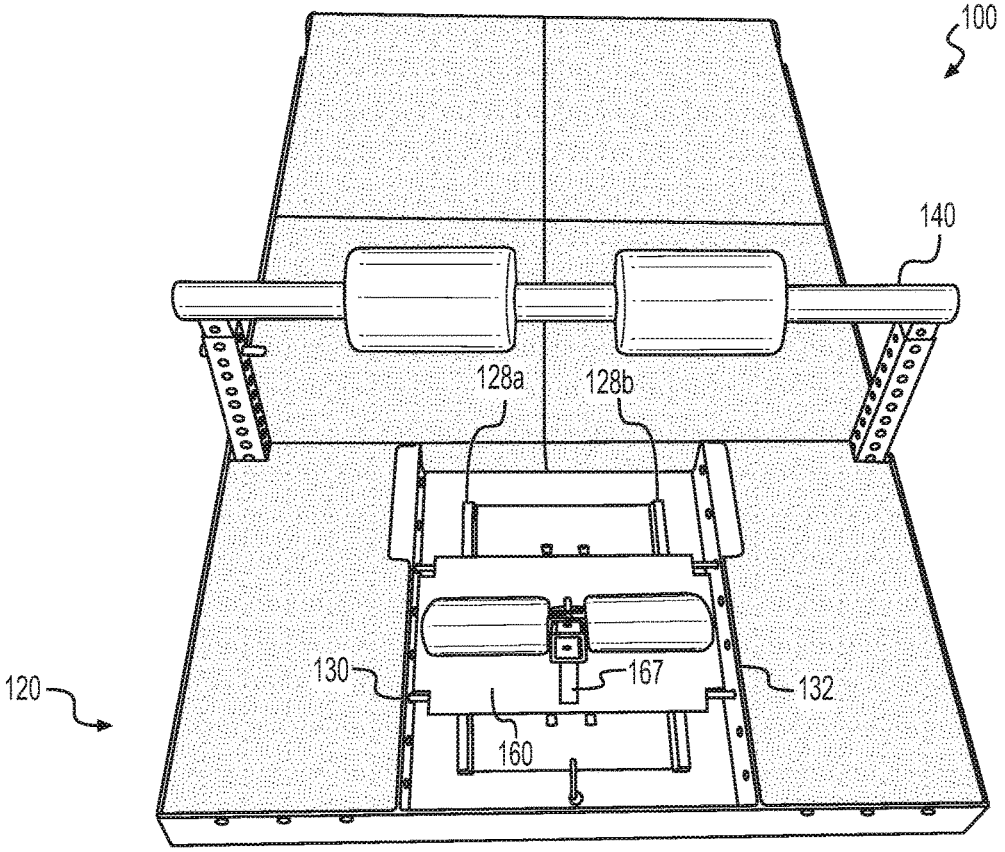
FIG. 7 is a front perspective view of the exercise apparatus shown in FIG. 1 according to another embodiment.

FIG. 7 depicts a front perspective view of the exercise apparatus shown to FIG. 1 according to another embodiment. Particularly, this embodiment shows the vertical support assembly 140 and the receiving mechanism 160 secured to the base frame 120.

The base frame 120 may further include one or more padding members thereon. The padding members may be formed from a suitable elastic material capable of temporary deformation/expansion, including, but not limited to, memory foam, polytetrafluoroethylene or other polymer materials. The padding members may be located in all sections of the base frame 120 other than the section between the support walls 130, 132 to prevent obstruction of the guide rails 128*a*, 128*b*. For example, as shown in FIG. 7, the padding members are located in sections adjacent to the first support wall 130 and the second support wall 132. In addition, the padding member is also located in the area behind the vertical support assembly 140. In some embodiments, a user may perform an exercise wherein the user's back is resting on the padding member behind the vertical support assembly 140. In further embodiments, the padding members in each section of the base frame 120 may have different heights.

In yet another embodiment, a method for exercising is provided. First, an exercise apparatus having a receiving mechanism and a vertical support assembly is provided. The receiving mechanism is adjacent to the vertical support assembly and is configured to move in a direction perpendicular to the vertical support assembly. After the exercise apparatus is provided, a height of the vertical support assembly is adjusted such that the vertical support assembly is located below the popliteal area, i.e, behind and below a user's knees. After the height of the vertical support assembly is adjusted, the receiving mechanism is adjusted in a direction perpendicular to the vertical support assembly such that an angle between receiving mechanism and the vertical support assembly is in a range between 0 to 60 degrees. After the receiving mechanism is adjusted, a user places their feet underneath one or more supports of the receiving mechanism and adjusts the height of the supports in a vertical direction to substantially immobilize a user's tibia and feet. After the receiving mechanism is adjusted, a user performs a squatting exercise until the user is in a substantially seated position. Then, the user continues downward, in a reverse crunch motion, until the user's back is substantially horizontal with a floor surface. Finally, from the lying position, the user performs a crunch and squats back up to an upright position to complete the exercise.

While certain exemplary embodiments and implementations have been described herein, other embodiments and modifications will be apparent from this description. Accordingly, the various embodiments described are not intended to be limiting, but rather are encompassed by the broader scope of the presented claims and various obvious modifications and equivalent arrangements.

What is claimed is:

1. An exercise apparatus, comprising:

a base frame comprising a first sidewall, a second sidewall, and an end wall;

at least two guide rails parallel to, positioned between, and immovable secured to the first sidewall and the second sidewall, wherein the at least two guide rails are perpendicular to and adjacent to the end wall;

a vertical support assembly comprising a first upright support bar extending perpendicular to the base frame on the first sidewall, a second upright support bar extending perpendicular to the base frame on the second sidewall, and a connecting bar removably attached to the first upright support bar and the second upright support bar; and a receiving mechanism mounted on the at least two guide rails, wherein the receiving mechanism is proximal to and aligned with the vertical support assembly;

wherein the receiving mechanism is configured to slide on the at least two guide rails parallel to the first sidewall and the second sidewall, wherein a first support wall and a second support wall are adjacent to each of the at least two guide rails, respectively, the first support wall and the second support wall each including one or more holes that are aligned with each other;

wherein the first support wall is parallel to and between the first sidewall and one of the at least two guide rails, and the second support wall is parallel to and between the second sidewall and another of the at least two guide rails.

2. The exercise apparatus of claim 1, wherein the receiving mechanism includes one or more pins on each side of the receiving mechanism, the pins are configured to releasably lock the receiving mechanism in the one or more holes on the first support wall and the second support wall.

3. The exercise apparatus of claim 2, wherein the one or more pins are spring loaded pins.

4. The exercise apparatus of claim 1, wherein the receiving mechanism comprises a base plate and a support surface perpendicular to the base plate, wherein the support surface comprises a mating channel that telescopes on a periphery of the support surface, the mating channel being releasably coupled to the support surface.

5. The exercise apparatus of claim 4, wherein the support surface and the mating channel comprise a plurality of holes along a length thereof, respectively, wherein the mating channel is releasably coupled to the support surface via a removable pin that is inserted into corresponding ones of the plurality of holes of the support surface and the mating channel.

6. The exercise apparatus of claim 4, wherein the mating channel comprises at least two perpendicular supports on opposing ends of the mating channel, the perpendicular supports including one or more pads.

7. The exercise apparatus of claim 4, wherein the base plate comprises at least four roller assemblies in a spaced apart orientation relative to each other and adjacent to corners of the receiving mechanism, wherein the at least four roller assemblies each comprise a roller axle, wherein the at least four roller assemblies are adapted to slide on the at least two guide rails of the base frame.

8. The exercise apparatus of claim 1, wherein the connecting bar comprises two support legs at opposing ends thereof, the two support legs telescope within the first upright support bar and the second upright support bar, respectively.

9. The exercise apparatus of claim 8, wherein the first upright support bar, the second upright support bar, and the two support legs each comprise a plurality of holes.

10. The exercise machine of claim 9, wherein a removable pin locks the two support legs in the first upright support bar and the second upright support bar, respectively, when corresponding ones of the plurality of holes are respectively aligned.

* * * * *